US006439428B1

(12) United States Patent
Schroeder et al.

(10) Patent No.: US 6,439,428 B1
(45) Date of Patent: Aug. 27, 2002

(54) DISPENSER WITH FEATURES FOR ENHANCED MAINTAINABILITY

(75) Inventors: Alfred A. Schroeder; Harlan R. Davis; Jeffrey A. Blansit, all of San Antonio; John D. Santy, Jr., Converse, all of TX (US)

(73) Assignee: Lancer Partnership L.L.P., San Antonio, TX (US)

( * ) Notice: Subject to any disclaimer, the term of this patent is extended or adjusted under 35 U.S.C. 154(b) by 0 days.

(21) Appl. No.: 09/631,496

(22) Filed: Aug. 3, 2000

(51) Int. Cl.[7] ..... F25C 5/18

(52) U.S. Cl. ..... 222/64; 222/66; 222/146.6; 222/238; 222/413; 222/405

(58) Field of Search ..... 62/137, 344; 222/64–66, 222/129.1–129.4, 146.6, 238, 239, 413, 405

(56) References Cited

U.S. PATENT DOCUMENTS 3,211,338 A * 10/1965 Weil et al. ..... 222/146.6 X
4,732,301 A * 3/1988 Tobias et al. ..... 62/344 X
4,822,966 A * 4/1989 Lind ..... 62/137 X
5,230,448 A * 7/1993 Stohmeyer et al. .. 222/146.6 X
5,405,052 A * 4/1995 Sawyer, III ..... 222/64
5,501,367 A * 3/1996 Chgira ..... 222/146.6 X
5,542,573 A * 8/1996 Frantz ..... 222/146.6 X
5,671,606 A * 9/1997 Schroeder et al. ..... 62/137
6,039,220 A * 3/2000 Jablonski et al. .... 222/146.6 X

* cited by examiner

*Primary Examiner*—Kenneth Bomberg
(74) *Attorney, Agent, or Firm*—Christopher L. Makay

(57) ABSTRACT

A dispenser with features for enhanced maintainability generally comprises a lower unit having therein an ice bin; an upper unit atop the lower unit for providing an interface for dispensing ice from the ice bin to the public; a conveyor having and inlet in the ice bin and an outlet in the upper unit; an ice distributor in a lower portion of the ice bin for conveying ice within the ice bin to the inlet; and a drive motor operably associated with the ice distributor, the drive motor being located in a space above the lower unit for ready access. A plurality of optical emitter assemblies are disposed upon a wall of the ice bin and a plurality of optical receiver assemblies are oppositely disposed upon a second wall of the ice bin. Each optical emitter assembly comprises an emitter housing and a selectively removable emitter body comprising an optical source. Each optical receiver assembly comprises a receiver housing and a selectively removable receiver body comprising an optical receiver. Modular flow control valves are adapted for substantially simultaneous electrical and fluid connection with mounting blocks on the upper unit.

37 Claims, 9 Drawing Sheets

DISPENSER WITH FEATURES FOR ENHANCED MAINTAINABILITY

FIELD OF THE INVENTION

The present invention relates to ice and beverage dispensers. More particularly, the invention relates to the improved arrangement and configuration of various generally known components of dispenser units for facilitating maintenance and preventing damage during ordinary operation.

BACKGROUND OF THE INVENTION

Combination ice and beverage dispenser units, as exemplified by U.S. Pat. No. 5,230,488 issued Jul. 27, 1993 to Strohmeyer et al., are now in common use for, among other reasons, their ability to provide the consuming public with a variety of beverage products, including ice, without waste of valuable commercial counter area. To further enhance this characteristic of combination dispensers, modular flow controllers, such as that described in U.S. patent application Ser. No. 09/496,441 filed Feb. 2, 2000, have been developed to interface with multi-flavor beverage dispensing air-mix nozzles. Such valves are designed to be compact, in order to allow as many as possible to be utilized in the smallest of dispensers. They are also designed to be modularly replaceable in order to ensure that failure of one may be readily remedied, in the field, without necessity for intervention by a factory-level service technician. In order to enhance maintainability of such combination dispenser, efforts have been made to ensure that their various components are readily accessible in the case of failure, which is especially important in the case where a dispenser is built into a counter top. As an example, U.S. Pat. No. 5,829,646 issued Nov. 3, 1998 to Schroeder et al. discloses a wheel for conveyance of ice to a delivery chute. In this patent, however, the wheel is placed at an angle, thereby allowing the drive motor therefor to be readily accessible at the front of the dispenser unit. Finally, redundancy is often built into dispenser units to ensure that single component failures do not immediately disrupt operation of the dispenser or cause more catastrophic damage. For example, U.S. Pat. No. 5,671,606 issued Sep. 30, 1997 to Schroeder et al. discloses the use of redundant optical sensors for determining the level of ice within an exemplary dispenser, thereby ensuring accurate measurement for interface with an automated ice delivery system.

It is an overriding object of the present invention to further develop and incorporate each of these principles into a combination ice and beverage dispenser unit that is extremely reliable in operation, yet highly-maintainable in case of component failure. It is, however, another object of the present invention, to extend such principles with regard for economy, eliminating redundancy where possible through better design.

SUMMARY OF THE INVENTION

In accordance with the foregoing objects, the present invention—a dispenser with features for enhanced maintainability—generally comprises a lower unit having therein an ice bin; an upper unit atop the lower unit for providing an interface for dispensing ice from the ice bin to the public; a conveyor, such as an auger, belt, or the like, having an inlet in the ice bin and an outlet in the upper unit; an ice distributor, such as a wheel, agitator bar, or the like, in a lower portion of the ice bin for conveying ice within the ice bin to the inlet; and a drive motor operably associated with the ice distributor, the drive motor being located in a space above the lower unit for ready access.

In another embodiment, the dispenser includes a plurality of optical emitter assemblies disposed upon a first interior sidewall of the ice bin and a plurality of optical receiver assemblies oppositely disposed upon a second interior sidewall of the ice bin. Each optical emitter assembly comprises an emitter housing, dependently attached to the first interior sidewall and in fixed electrical communication with a control circuit, and an emitter body comprising an optical source. The emitter body is adapted for removable engagement with the emitter housing for establishing an electrical connection between the optical source and the control circuit. Likewise, each optical receiver assembly comprises a receiver housing, dependently attached to the second interior sidewall and in fixed electrical communication with the control circuit and a receiver body comprising an optical receiver. The receiver body is adapted for removable engagement with the receiver housing for establishing an electrical connection between the optical receiver and the control circuit.

In yet another embodiment, the dispenser is provided with modular flow control valves adapted for substantially simultaneous electrical and fluid connection with mounting blocks on the upper unit. In particular, an electrical connector is fixed in position upon each flow controller such that connection of a fluid connector on the flow controller with a corresponding fluid connector on the mounting block cause substantially simultaneous engagement of the flow controller's electrical connector with a corresponding electrical connector on the mounting block.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
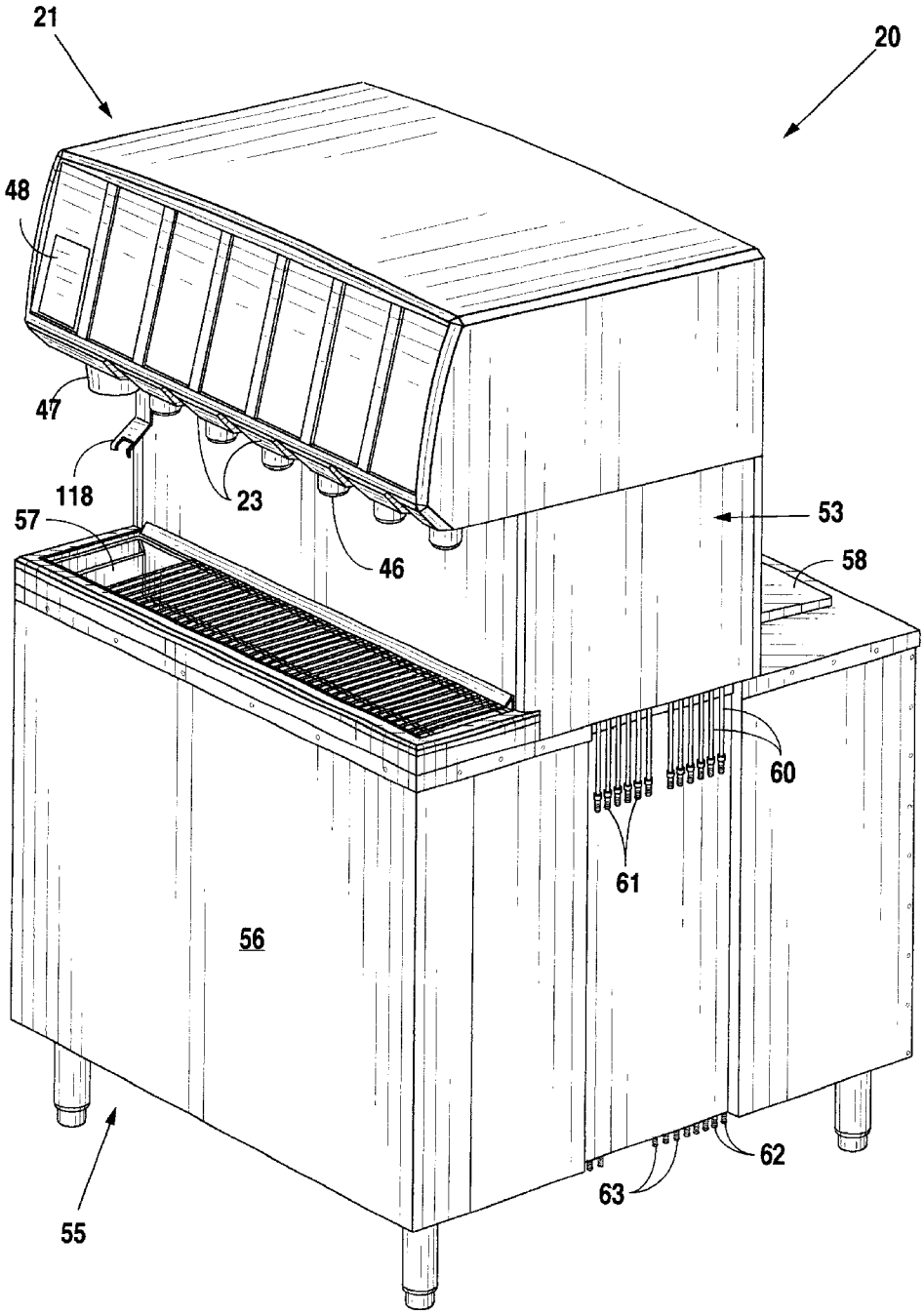
FIG. 1 shows, in perspective view, the enhanced ice and beverage dispenser exemplary of the preferred embodiment of the present invention.
Figure 2:
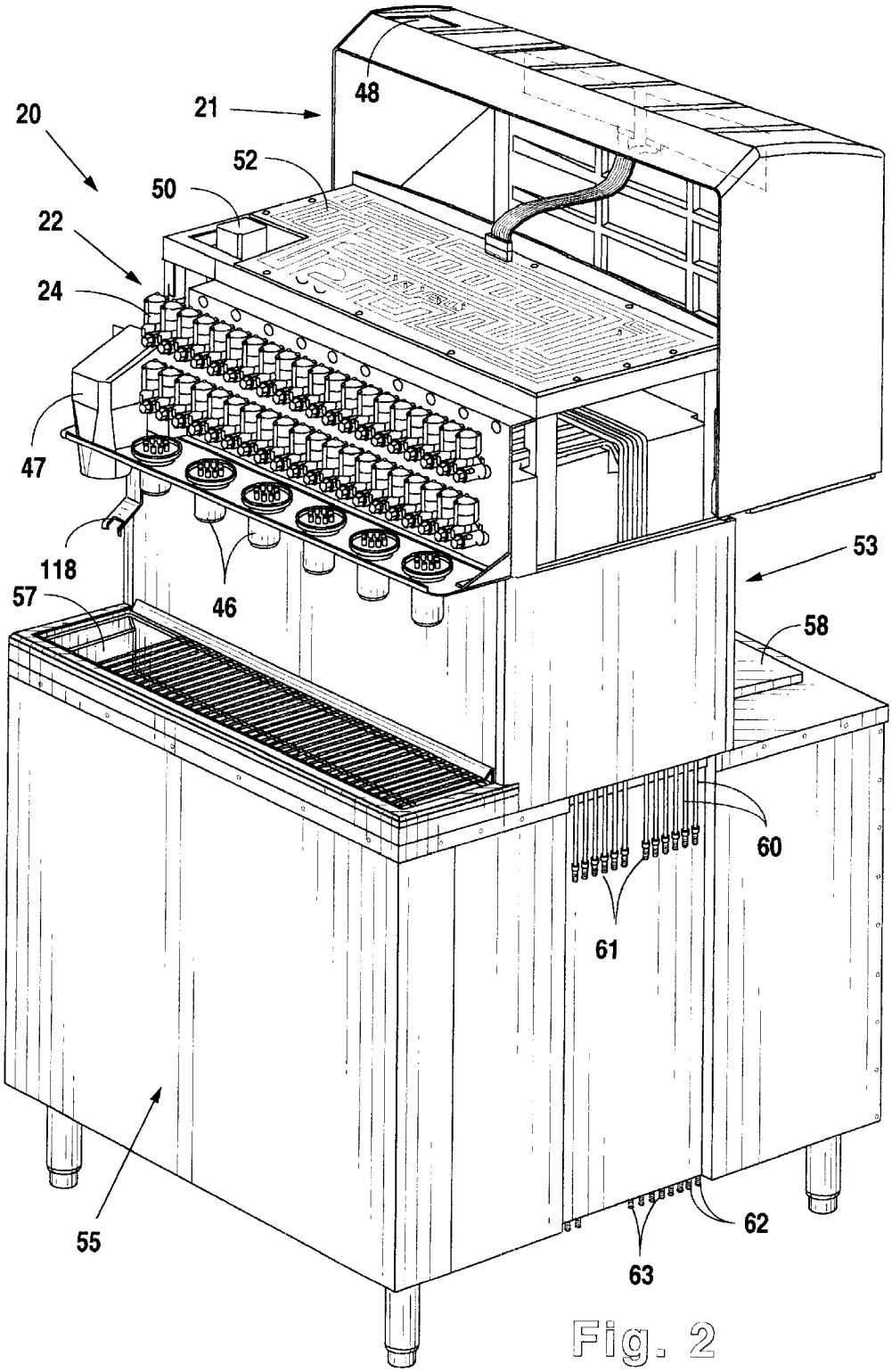
FIG. 2 shows, in perspective view, the dispenser of FIG. 1 with an upper lid opened for viewing of several internal components.

Referring now to the Figures, an ice and beverage dispensing unit 20 is shown to generally comprise an upper unit 21 and a lower unit 55, as is typical in the art as exemplified by U.S. Pat. No. 5,230,448 issued Jul. 27, 1993 to Strohmeyer et al. As particularly shown in FIGS. 2 and 3, the upper unit 21 comprises a plurality of combination mixing and dispensing valves 22, and ice dispensing nozzle 47 and a micro-controller based control circuit 52. As also shown, the lower unit 55 houses an ice bin 64 atop a cold plate 95. A plurality of inlets 63 is provided to an equal plurality of cooled product lines 62, which enter through the outer housing 56 of the lower unit 55, through the cold plate 95, and are then routed to the combination mixing and dispensing valves 22. Similarly, a plurality of inlets 61 is provided to an equal plurality of ambient temperature product lines 60, which route directly to the combination mixing and dispensing valves 22, which in the preferred embodiment comprise modular flow controllers 24 in combination with multi-flavor beverage dispensing air-mix nozzles 46. As in other beverage dispensing units, depression of one of the plurality of beverage dispense membrane switches 23 activates the micro-controller based control circuit 52 to control metering of basic syrups and bonus flavors through the cooled and ambient temperature product lines 62, 60 and through the modular flow controllers 24 to the air-mix nozzles 46. Likewise, a catch pan 57 is provided for the overflow of fluid products. In the present invention, however, the modular flow controllers 24 have been modified from prior embodiments in order to enhance their manner of interface with mounting blocks 39 to the ambient temperature product lines 60, cooled product lines 62 and micro-controller based control circuit 52.

Figure 3:
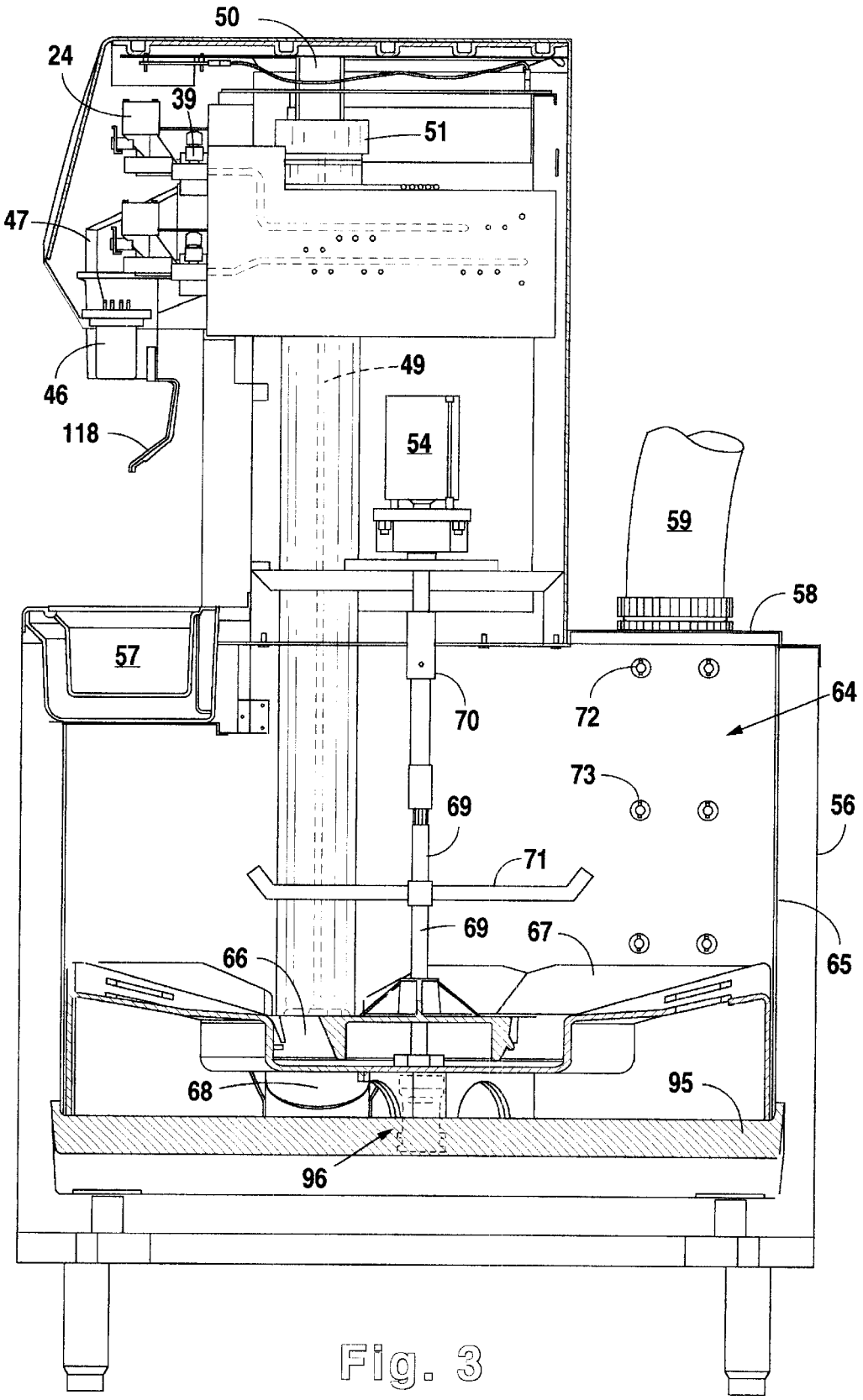
FIG. 3 shows, in a side cross-sectional view, several of the various internal components of the dispenser of FIG. 1.
Figure 4:
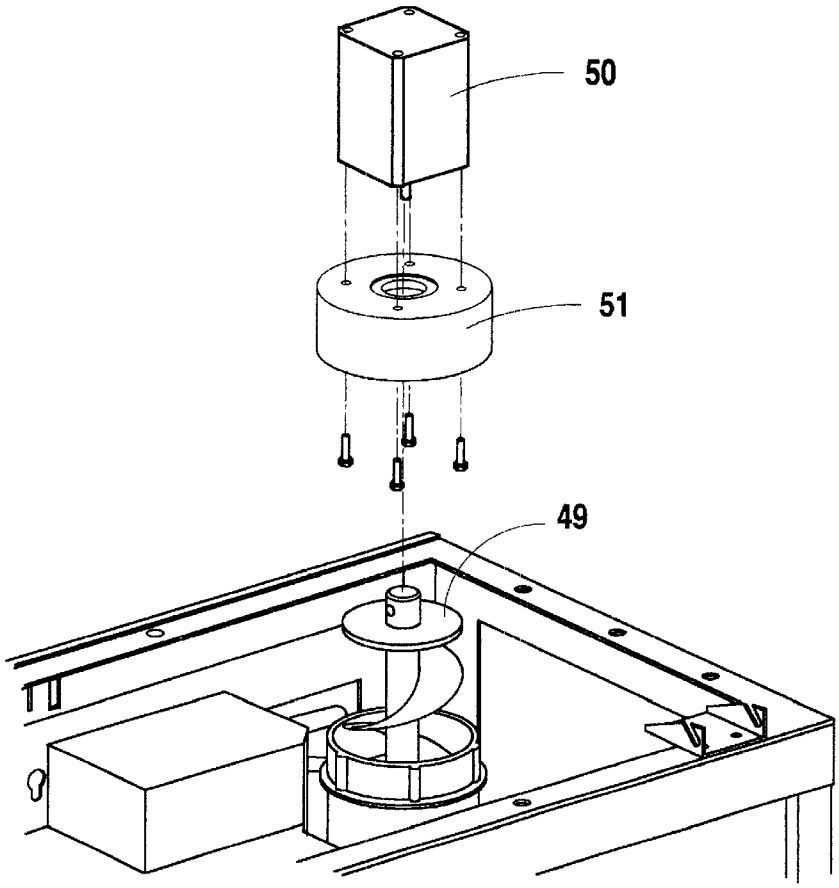
FIG. 4 shows, in an exploded partial perspective view, details of a portion of the conveyor of the dispenser of FIG. 1.

As shown in FIG. 3, the ice and beverage dispensing unit 20 also comprises an ice distributor 66, which in this preferred embodiment is a wheel, agitator bar, or the like, at the base of ice bin 64 for directing ice from ice bin 64 to a recess 68 at the base of ice conveyor 49, which in this preferred embodiment is an auger, belt, or the like. As in prior embodiments, deflection of ice dispense switch 118 causes activation of conveyor motor 50 to draw ice from the recess 68 through the ice conveyor 49 to the conveyor top housing 51 and out ice dispensing nozzle 47. Deflection of switch 118 also causes activation of gear motor 54 to operate ice distributor 66 for the supply of ice from within the various locations of ice bin 64 to recess 68, which may be formed separately or as part of a ice distributor shroud 67. The gear motor 54 may also, of course, be operated independently of switch 118 on, for example, a timer mechanism, to allow disruption of the ice within the ice bin 64 by an agitator bar 71. In this manner, freezing together of the ice may be prevented during extended periods between dispense operations. In the present invention, however, various modifications of the prior art have been effected in order to allow the gear motor 54 to be positioned in the intermediate space 53 between the upper unit 21 and lower unit 55. In this manner, the area allotted for ice bin 64 is maximized while still allowing access to gear motor 54 for maintenance purposes. Likewise, in order to operate the conveyor motor 50 at an optimum speed, thereby preventing repeated, pulsed starts and stops by the user, an ice dispense speed membrane switch 48 is also provided in the present invention. This switch 48, in communication with the micro-controller based control circuit 52, preferably allows the user to select from either FAST, MEDIUM or SLOW dispense rates upon activation of switch 118. Those of ordinary skill in the art, however, will recognize the many substantially equivalent alternatives as may be implemented.

As in other prior dispensing units, an ice bin access lid 58 is provided through the outer housing 56 of lower unit 55 to the interior of ice bin housing 65. As has also been previously implemented, a plurality of optical emitter assemblies 72 and corresponding optical detector assemblies 73 are provided in strategic locations of ice bin housing 65 to monitor the level of ice within ice bin 64. In the present invention, however, the optical emitter and detector assemblies 72, 73 have been modularized to allow their selective employment and easy maintenance in case of failure. For example, while prior embodiments have utilized as may as six pairs for redundancy reasons, the preferred implementation now dispenses with the redundancy requirement. In embodiments where the ice bin 64 is in communication with an automated ice delivery system through, for example, ice supply conduit 59, only three emitter-detector assembly pairs 72,73 are required. Likewise, in embodiments wherein ice is manually loaded through ice bin access lid 58, only two emitter-detector assembly pairs 72, 73 are required to indicate to the user the level of ice within ice bin 64.

Referring now to the remaining Figures, details of the various improvements of the present invention are now provided. Although described in the context of a combination ice and beverage dispensing unit 20, it to be appreciated that various aspects of the improvements disclosed herein may be employed singly or in combination with other of the aspects. For example, the enhanced interface between the modular flow controllers 24 and mounting blocks 39 will greatly simplify maintenance of any beverage dispensing unit whether or not the unit has an ice dispensing capability. Likewise, the improved arrangement of components enabling the location of gear motor 54 within the intermediate space 53 atop the lower unit 55 is beneficial for the maintenance of many ice dispensing units whether or not they include a beverage dispensing capability. On the other hand, it will also be appreciated that the combination of the various aspects of the present invention goes far to produce an overall result of a highly maintainable combination ice and beverage dispensing unit 20.

The use of an ice distributor 66, such as the illustrated wheel, for the conveyance of ice within an ice bin is exemplified in the art by U.S. Pat. No. 5,829,646 issued Nov. 3, 1998 to Schroeder et al. ("the '646 patent"). By this reference, the full disclosure of U.S. Pat. No. 5,829,646 is incorporated herein as though now set forth in its entirety. As shown in the single '646 patent, the gear motor for driving such a wheel is typically located adjacent and beneath the wheel in order to avoid a long shaft length. In this manner, binding of the shaft is prevented. As shown in the '646 patent, prior embodiments have placed the wheel in an upright position in order to allow easier access to the gear motor, for maintenance and/or replacement, than would be possible in embodiments where the gear motor is at the very base of the ice bin beneath a horizontally positioned wheel. In order to maximize the area available for storage of ice within the ice bin 64, however, it is desirable that the wheel be placed in a horizontal plane with the gear motor 54 being placed in the relatively accessible intermediate space 53 between the upper unit 21 and the lower unit 55. Unfortunately, in such an embodiment the weight of the ice within the ice bin 64 upon the ice distributor 66 creates a strong transverse moment arm upon shaft 69. This results in a need to ensure accurate alignment of the shaft 69 with the coupling 70 to the gear motor 54. The present invention overcomes this limitation, however, by the provision of a novel bearing assembly 96 cast within the cold plate 95 beneath the ice distributor 66. As will be better understood further herein, this unique bearing assembly 96 provides several degrees of freedom for shaft 69 to align with the motor coupling 70.

Figure 6:
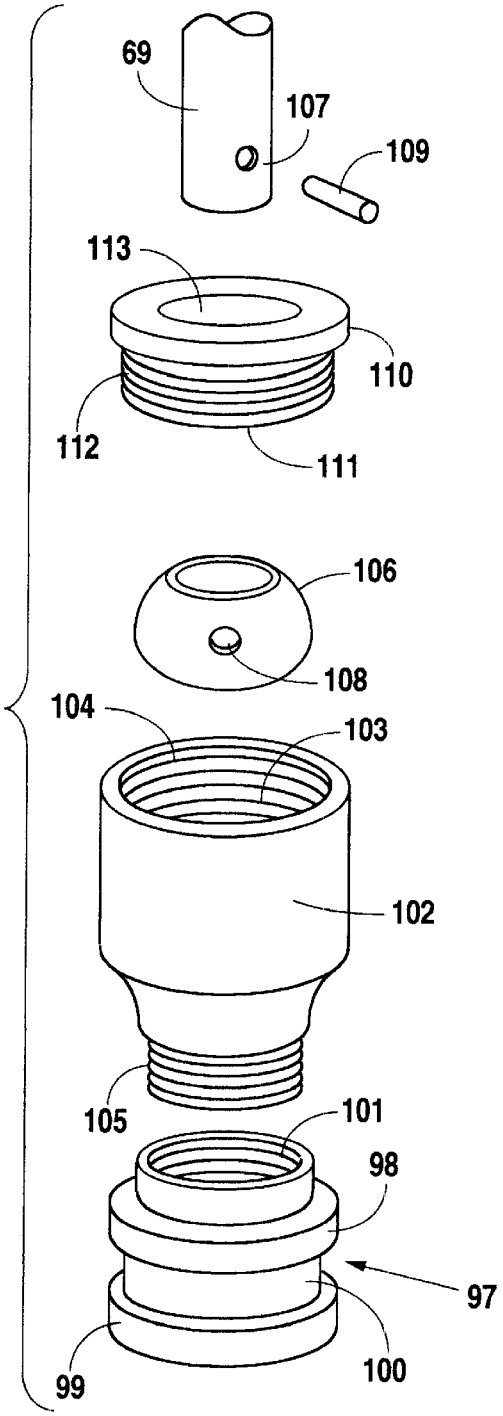
FIG. 6 shows, in an exploded perspective view, details of a bearing assembly internal the dispenser of FIG. 1.

Referring now to FIG. 6, the bearing assembly 96 is shown with the lower most portion of shaft 69 in an exploded view. As shown in the Figure, the bearing assembly 96 is mounted upon a stainless steel carrier 97, which comprises an upper flange 98 and a lower flange 99 with an annular groove 100 therebetween. The flanged stainless steel carrier 97 is cast within cold plate 95 directly beneath the center of the ice distributor 66. Although those of ordinary skill in the art will recognize many alternatives, such as screws or bolts, casting the flanged carrier 97 within the cold plate 95 eliminates any concern that bacteria and the like might collect within the threads of other mounting hardware.

Figure 7:
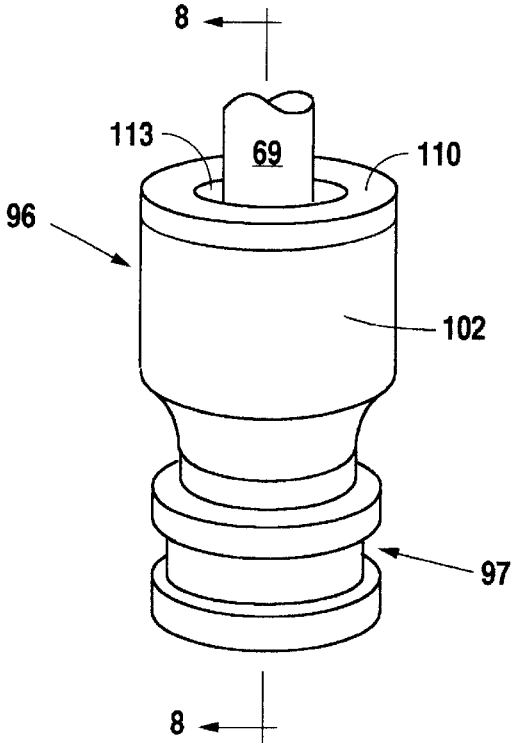
FIG. 7 shows, in perspective view, the bearing assembly of FIG. 6.
Figure 8:
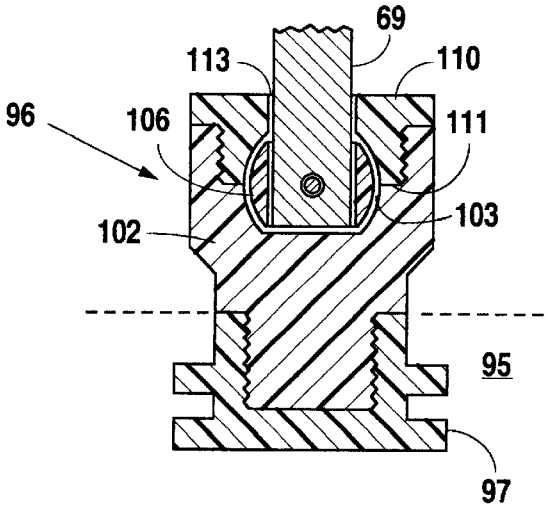
FIG. 8 shows, in a cross-sectional view taken along line 8—8 in FIG. 7, the bearing assembly of FIG. 6.

The stainless steel carrier 97 is provided with female threading 101 at an upper neck extending out of and above the cold plate 95 for interface with corresponding male threading 105 of a polyacetal socket 102, as shown in FIG. 7. As shown in FIG. 8, the interior of the polyacetal socket 102 is shaped to form a lower socket cavity 103. Female threading 104 is provided on the interior, top portion of the polyacetal socket 102 for interface with corresponding male threading 112 of polyacetal cap 110. As also shown in FIG. 8, an upper socket cavity 111 is formed in the lower portion of the polyacetal cap 110.

The shaft 69 may thus be inserted through an orifice 113 in the polyacetal cap 110 and mated with a polyacetal bearing 106, which is secured to shaft 69 by insertion of a press pin through bore 108 in bearing 106 and bore 107 through shaft 69. Polyacetal cap 110 may then be screwed onto the polyacetal socket 102 securing the bearing 106, and consequently the lower portion of shaft 69, within the bearing assembly 96. Because the orifice 113 is slightly greater in diameter than shaft 69, the shaft may be tilted up to several degrees for alignment with the coupling 70 to gear motor 54. Finally, although those of ordinary skill in the art will recognize that other designs may be implemented, it is preferred that the socket 102 and bearing 106 comprise a material such as polyacetal in order to prevent the necessity of lubricants in the bearing assembly 96, which might contaminate the ice within the ice bin 64.

Previous embodiments of ice dispensers have included means for sensing and controlling the level of ice within the ice bin. For example, U.S. Pat. No. 5,671,606 issued Sep. 30, 1997 to Schoeder et al. ("the '606 patent") discloses an apparatus for monitoring and controlling the level of ice in an ice storage container that includes an emitter mounted within the ice storage container and a detector mounted directly opposite from the emitter. By this reference, the full disclosure of U.S. Pat. No. 5,671,606 is incorporated herein as though now set forth in its entirety. As described in the '606 patent, the optical emitter assembly 72 and the optical detector assembly 73 of the present invention operate to detect the level of ice within ice bin 64. In this manner, a low ice condition may be indicated through the micro-controller based control circuit 52 to the ice and beverage unit's operator and/or ice may be automatically routed to the ice bin 64 from an ice delivery system in communication with ice supply conduit 59 through the ice bin access lid 58. Exemplary of such an automated ice delivery system is that disclosed in U.S. patent application Ser. No. 09/411,457 filed Oct. 1, 1999 ("the '457 application"). By this reference, the full disclosure of U.S. patent application Ser. No. 09/411,457 is incorporated herein as though now set forth in its entirety.

Although the optical emitter assembly 72 and optical detector assembly 73 each operate as disclosed in the '606 patent, the assemblies 72, 73 of the present invention differ in that they are easily replaceable. In this manner, redundancy requirements are eliminated, greatly reducing cost to the end user. According to the present invention, instead of a unitary construction for the assemblies 72, 73, a two-part assembly is provided for each. As will be better understood further herein, provision within each assembly 72, 73 is made to ensure that an emitter assembly 72 is not mistaken for a detector assembly 73 and vice versa. In particular, a system of keys and alignment slots is provided unique to each assembly in order that a user may only mate emitter components with the emitter assembly 72 and detector components with the detector assembly 73.

Figure 5:
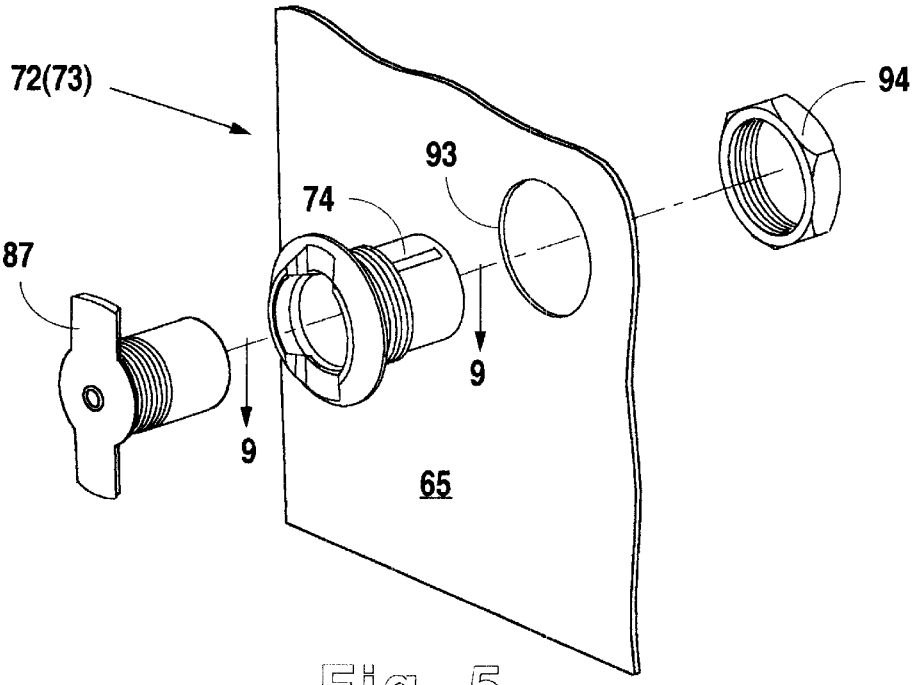
FIG. 5 shows, in an exploded perspective view, an optical emitter (or detector) assembly of the dispenser of FIG. 1.
Figure 9:
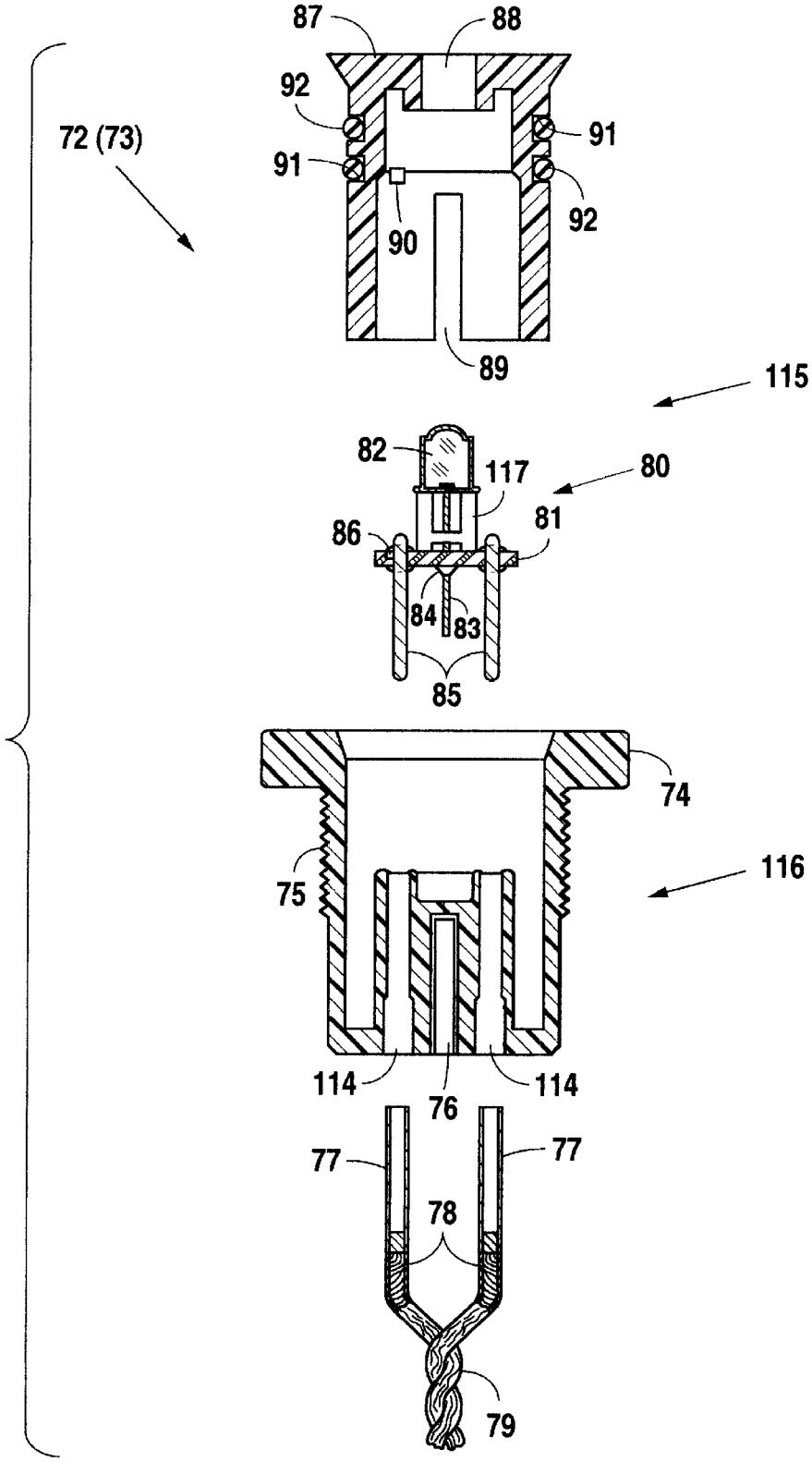
FIG. 9 shows, in an exploded cross-sectional view taken along line 9—9 in FIG. 5, details of the assembly of FIG. 5.
Figure 10:
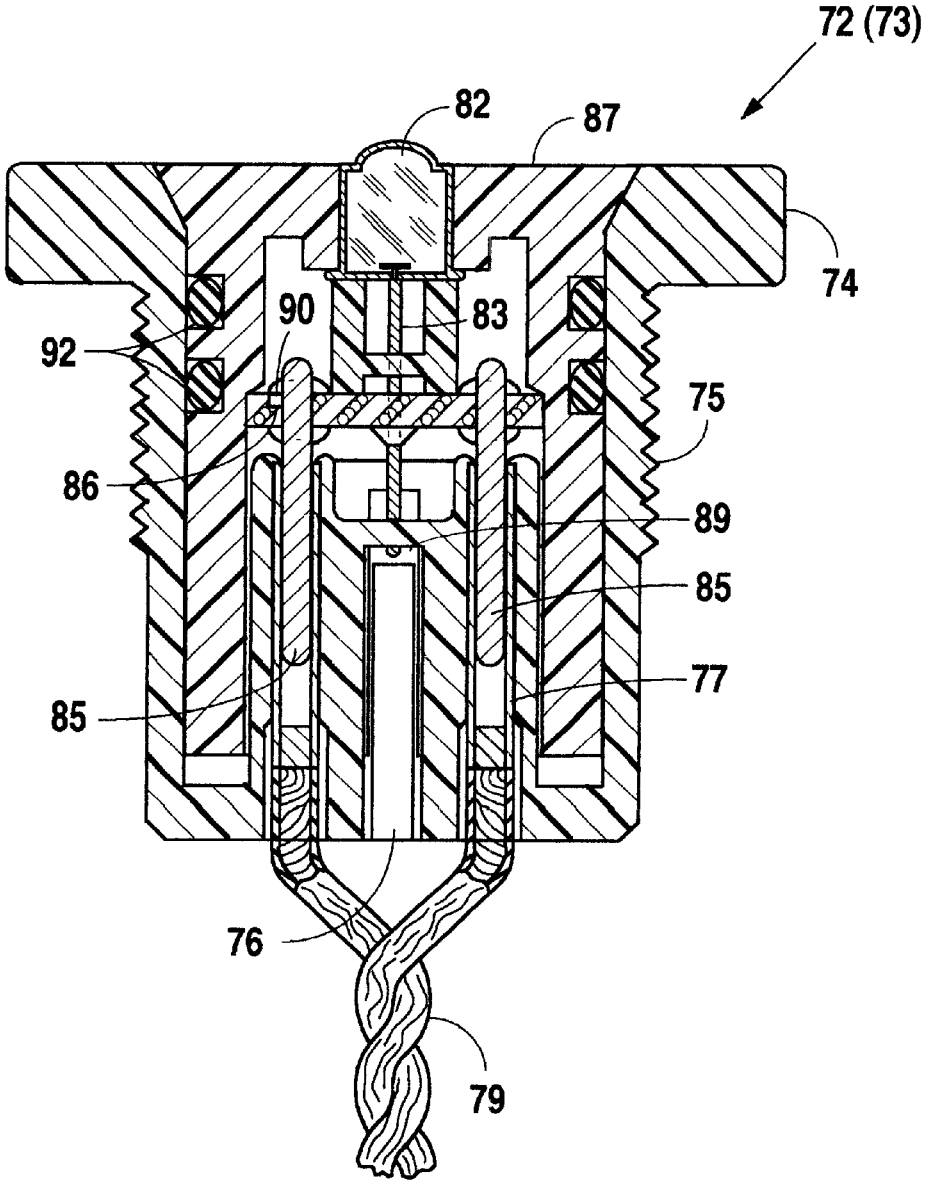
FIG. 10 shows, in collapsed cross-sectional view from the same perspective as that of FIG. 9, the assembly of FIG. 5.

Referring now to FIG. 9, in particular, an optical emitter assembly 72 is detailed as exemplary of both the optical emitter assembly 72 and optical detector assembly 73. It is to be understood, however, that the relative alignment of the keys and alignment slots now described should be different for the two assemblies 72, 73, while the remaining components are substantially identical. As shown in the Figure, each assembly generally comprises a body assembly 115 for operative mating with a housing assembly 116. The body assembly 115 generally comprises a header assembly 80 permanently mated with an acrylonitrile butadiene styrene ("ABS") body 87. Likewise, the housing assembly 116 generally comprises a plurality of female sockets 77 permanently mated within an ABS housing 74. As generally shown in FIG. 5, the housing 74 is inserted through an emitter or detector orifice 93 in the ice bin housing 65 and secured thereto with a nut 94 or other similar mounting hardware. Wire leads 79, which are crimped or soldered 78 within the female sockets 77, are then permanently connected to the micro-controller based control circuit 52. Annular female threading 75 is preferably provided on housing 74 for this purpose. As is shown in FIG. 9, recesses 114 are provided for receipt of the female sockets 77, which are preferably held in place with an epoxy to thereby help form a seal of the mounting orifice 93.

Each header assembly 80 generally comprises a printed circuit ("PC") board substrate for mounting of a light emitting diode ("LED") 82, in the case of an optical emitter assembly 72, or a photodetector, in the case of an optical detector assembly 73. The anode 83 or cathode of the LED 82 are then soldered 84 to the PC board 81. Electrical connection is thereby made between the LED 82 and a plurality of male plugs 85, which are arranged in accordance with the positioning of an alignment slot 86 and key 90 as well as the alignment of alignment slot 89 and key 76 in the body 74 to interface with female sockets 77. A standoff 117 is provided to cause the LED 82 or photodetector to protrude through an emitter orifice 88 or detector orifice, as appropriate. The header assembly 80 is preferably epoxied into the ABS body 87 such that when the body assembly 115 is mated with the housing assembly 116 a complete seal is made of the orifice 93 in the ice bin housing 65. To further ensure that this seal is made, a plurality of annular grooves 91 are provided about body 87 for provision of a plurality of polymeric O-rings 92.

In an alternative embodiment, a blank body 87 may be produced wherein orifice 88 is either nonexistent or filled with epoxy so that the emitter and/or detector mounting orifices 93 may be sealed without the necessity of providing the more expensive header assembly 80 and components thereon. In this case one blank body 87 would be configured with alignment slot 89 corresponding to the location of key 76 of the optical emitter assembly 72 and another configuration of the blank body 87 would have its alignment slot 89 corresponding to the location of key 76 of the optical detector assembly 73. While those of ordinary skill in the art will recognize that it is also possible for a general plug to be configured for the emitter and/or detector mounting orifices 93, it is desirable that the ice bin housing 65 be factory provided with at least the housing assembly 116 as now described in order that wiring 79 may be connected to the micro-controller based control circuit 52 by factory personnel rather than field service technicians. This compromise will allow users to later add automated ice supply systems, which generally require additional emitter and detector pairs, without requiring removal and replacement of the ice bin housing 65 or modification involving wiring to the control circuit 52. Likewise, it is not necessary to provide the expensive header assembly 80 to those users that do not wish to have the capability to interface to such an automated system. In the case of users already implementing automated systems, the modular design of the housing assembly 116 and body assembly 115 facilitate maintenance and repair inasmuch as the service technician is required only to remove the body assembly 115 from the housing assembly 116, by simply pulling the two apart, and replacing it with another, by pushing a new body assembly 115 into the housing assembly 116. Because no soldering is required, the chance for damage to the microcontroller based control circuit 52 and/or an intermittent electrical connection is greatly diminished. The overall result is enhanced reliability and increased user options at an economical price.

Figure 11:
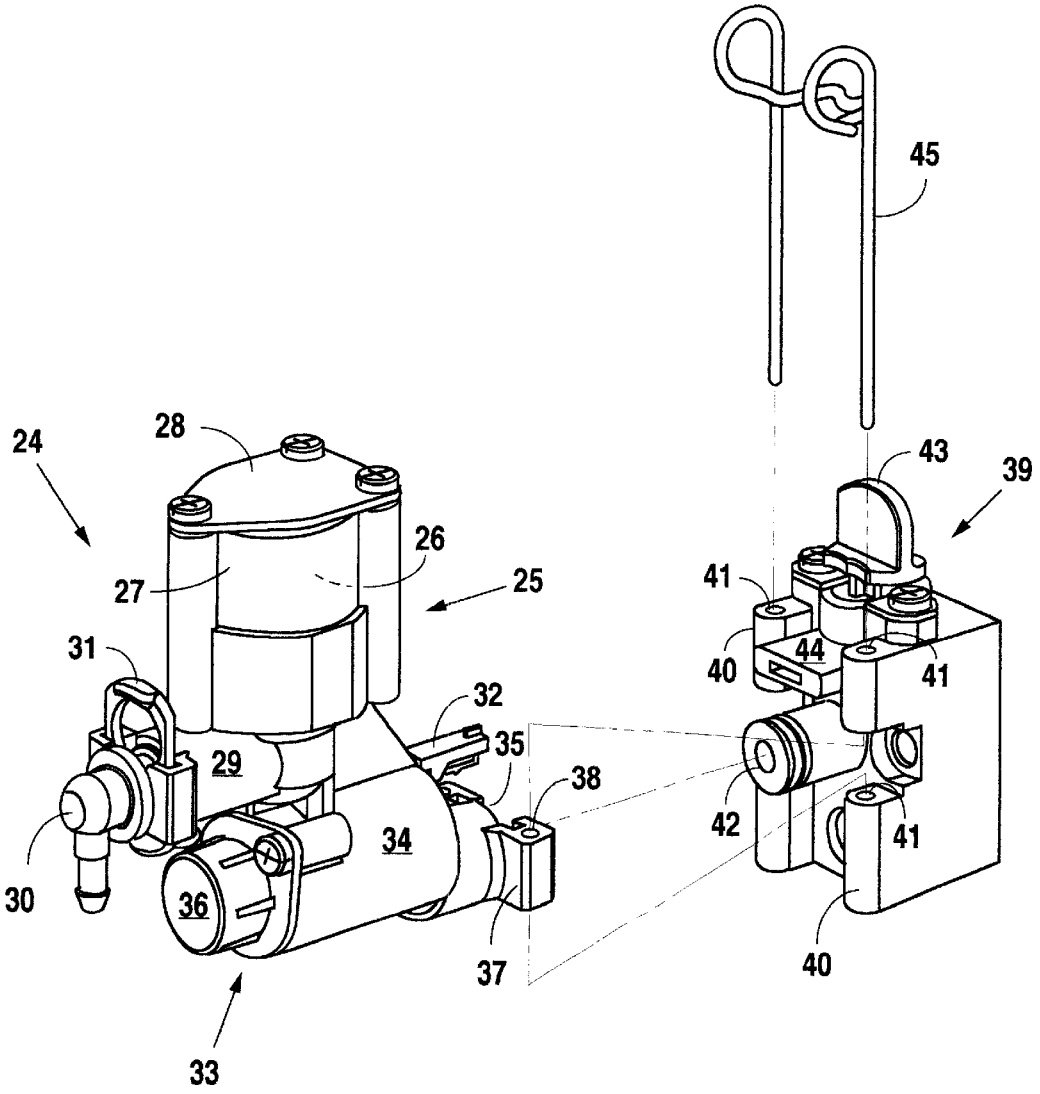
FIG. 11 shows, in perspective view a modular flow controller and a mounting block of the dispenser of FIG. 1.

It is likewise desired that the modular flow controllers 24 be replaceable as simply as possibly. As shown in FIG. 11, each modular flow controller 24 is adapted to interface with a mounting block 39. While the flow controller 24 and mounting block 39 of the present invention are essentially the same as that described in U.S. patent application Ser. No. 09/496,441 filed Feb. 2, 2000, the full disclosure of which is by this reference incorporated herein as though now set forth in its entirety, additional provision is added in the present invention to further facilitate coupling and decoupling of the flow controllers 24 to and from their respective mounting blocks 39.

Figure 12:
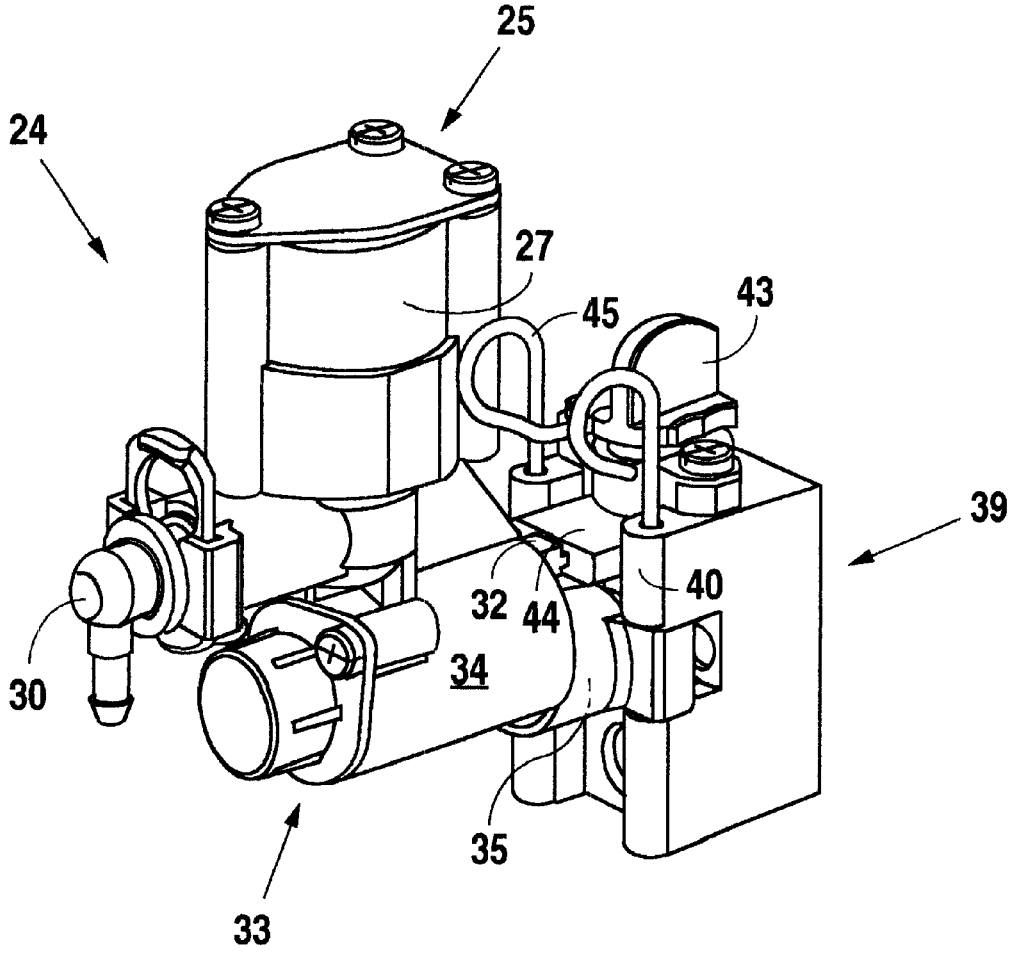
FIG. 12 shows the controller and mounting block of FIG. 11 as operably mated together.

As shown in FIGS. 11 and 12, and described in the '441 application, each modular flow controller 24 generally comprises a valve assembly 25 and flow control assembly 33. The valve assembly 25 in turn comprises a solenoid actuated valve 26 contained within an inductor shroud 27 by valve retainer 28. A manifold outlet 29 enables flow from the flow control assembly 33 to a nozzle connector fitting 30, which is retained in place by sliding element 31. A male electric connector 32 is provided for controlling communication with the micro-controller based control circuit 52 through the mounting block 39, as will be better understood further herein.

As also described in the '441 application, the flow control assembly generally comprises a flow control body 34 having a drink integrity lock 36 for restricting access to a provided adjustment means within the body 34. A female fluid coupling 35 is provided for interface with a corresponding male fluid coupling 42 on the mounting block 39. According to the improvement of the present invention, however, the male electric connector 32 of the valve assembly 25 and female fluid coupling 35 of the flow control assembly 33 are fixedly positioned to interface simultaneously with a female electric connector 44 and the male fluid coupling 42, respectively, fixedly attached to the mounting block 39. In this manner, a user may remove a modular flow controller 24 from a mounting block 39 by simply turning off fluid cut-off valve 43, removing flow controller securing bracket 45 from the guide bores 38 and 41 of the mounting block 39 and flow control assembly 33 and thereafter simply pulling the modular controller 24 assembly apart form the mounting block 39. As a result of the simultaneous disconnection of the electrical connectors 32, 44 with the fluid couplings 35, 42 the chance for damage to the electrical connection by pulling of wires or the like is eliminated. This improvement prevents costly factory repair of the mixing and dispensing valves 22 due to careless replacement of the modular flow controllers 24. To replace the modular flow controller 24, the process is simply repeated starting with the simultaneous fluid and electrical connection followed by the insertion of the securing bracket 45 into guide bores 41 and 38 and ending with the opening of fluid cut-off valve 43.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. A highly-maintainable dispenser for providing a product to the consuming public, said dispenser comprising:

a lower unit having therein an ice bin;

an upper unit atop said lower unit, said upper unit providing an interface for dispensing ice from said ice bin to the public;

a conveyor having an inlet and an outlet, said inlet being located within said ice bin and said outlet being in communication with said interface;

a conveyor motor operably associated with said conveyor for communicating ice from said inlet to said outlet;

an ice distributor in a lower portion of said ice bin, said ice distributor being adapted to convey ice within said ice bin to said inlet; and a drive motor operably associated with said ice distributor, said drive motor being located above said-ice distributor.

2. The dispenser as recited in claim 1, said dispenser further comprising a shaft disposed between said drive motor and said ice distributor.

3. The dispenser as recited in claim 2, wherein said lower unit comprises:

a plurality of optical emitter assemblies vertically disposed upon a first interior face of said ice bin;

a plurality of optical receiver assemblies vertically disposed upon a second interior face of said ice bin, said second face being opposite said first face; and wherein said each said optical receiver assembly is adapted to receive an optical signal generated by one of said optical emitter assemblies for determining the level of ice within said ice bin.

4. The dispenser as recited in claim 3, wherein each said optical emitter assembly comprises:

an emitter housing, said emitter housing being fixedly attached to said first interior face and adapted for fixed electrical communication with a dispenser controller;

an emitter body, said emitter body comprising an optical source; and wherein said emitter body is adapted to removably mate with said emitter housing for establishing an electrical connection between said optical source and the dispenser controller.

5. The dispenser as recited in claim 4, wherein each said optical receiver assembly comprises:

a receiver housing, said receiver housing being fixedly attached to said second interior face and adapted for fixed electrical communication with the dispenser controller;

a receiver body, said receiver body comprising an optical receiver; and wherein said receiver body is adapted to removably mate with said receiver housing for establishing an electrical connection between said optical receiver and the dispenser controller.

6. The dispenser as recited in claim 5, wherein:

each said emitter assembly comprises a first key and a first slot, said first key being arranged relative to said first slot to facilitate mating of said emitter body with said emitter housing;

each said receiver assembly comprises a second key and second slot, said second key being arrange relative to said second slot to facilitate mating of said receiver body with said receiver housing; and said relative arrangement of said second key with said second slot differs from said relative arrangement of said first key with said first slot.

7. The dispenser as recited in claim 5, wherein said lower unit is adapted for connection of said ice bin with an automated ice delivery system.

8. The dispenser as recited in claim 2, said dispenser further comprising an conveyor speed selection switch, said conveyor speed selection switch being adapted to vary the rate at which said conveyor transfers ice from said ice bin to said interface.

9. The dispenser as recited in claim 1, wherein said upper unit is adapted to provide a second interface for dispensing a drink product to the public.

10. The dispenser as recited in claim 9, wherein said lower unit comprises a cold plate, said cold plate being adapted to chill the drink product to be dispensed to the public.

11. The dispenser as recited in claim 9, wherein said second interface comprises:

a plurality of modular dispensing valves; and a plurality of mounting blocks, said mounting blocks being adapted to receive one each of said modular dispensing valves.

12. The dispenser as recited in claim 11, wherein:

said modular dispensing valves each comprise a first electrical connector and a first fluid connector;

said mounting blocks each comprise a second electrical connector and a second fluid connector; and wherein said first electrical connector is adapted to mate with said second electrical connector and said first fluid connector is adapted to mate with said second fluid connector.

13. The dispenser as recited in claim 12, wherein each said connector is positioned such that mating of said fluid connectors results in substantially simultaneous mating of said electrical connectors.

14. The dispenser as recited in claim 1, wherein said conveyor comprises an auger.

15. The dispenser as recited in claim 1, wherein said ice distributor comprises a wheel.

16. The dispenser as recited in claim 1, wherein said conveyor comprises an auger.

17. The dispenser as recited in claim 1, wherein said ice distributor comprises a wheel.

18. An dispenser for dispensing ice, said dispenser comprising:

an ice bin for holding a quantity of ice;

a mechanism for dispensing ice from within said bin to an outlet;

a detector for determining the level of ice within said bin, said detector comprising:

a control circuit;

a plurality of optical emitter assemblies disposed upon a first interior side wall of said ice bin, each said optical emitter assembly comprising:

an emitter housing, said emitter housing being dependently attached to said first interior side wall and in fixed electrical communication with said control circuit;

an emitter body, said emitter body comprising an optical source; and wherein said emitter body is adapted for removable engagement with said emitter housing for establishing an electrical connection between said optical source and said control circuit;

a plurality of optical receiver assemblies disposed upon a second interior side wall of said ice bin, each said optical receiver assembly comprising:

a receiver housing, said receiver housing being dependently attached to said second interior side wall and in fixed electrical communication with said control circuit;

a receiver body, said receiver body comprising an optical receiver; and wherein said receiver body is adapted for removable engagement with said receiver housing for establishing an electrical connection between said optical receiver and said control circuit; and wherein each said optical receiver assembly is adapted to receive an optical signal generated by one of said optical emitter assemblies.

19. A highly-maintainable dispenser for providing a product to the consuming public, said dispenser comprising:

a lower unit having therein an ice bin;

an upper unit atop said lower unit, said upper unit providing an interface for dispensing ice from said ice bin to the public;

a conveyor having an inlet and an outlet, said inlet being located within said ice bin and said outlet being in communication with said interface;

an ice distributor in a lower portion of said ice bin, said ice distributor being adapted to convey ice within said ice bin to said inlet;

a drive motor operably associated with said ice distributor, said drive motor being located above said ice distributor;

a shaft disposed between said drive motor and said ice distributor; and a bearing assembly coupled with the shaft, the bearing assembly providing several degrees of freedom to facilitate proper alignment between the shaft and the drive motor.

20. The dispenser as recited in claim 19, wherein said bearing assembly comprises:

a carrier member fixedly positioned in a base portion of said lower unit; and a socket removably attached to said carrier member, said socket being adapted to receive a bearing affixed to said first end of said shaft.

21. The dispenser as recited in claim 20, wherein said socket comprises:

a lower portion, said lower portion comprising a lower cavity;

a cap adapted to removably attach to said lower portion, said cap comprising an upper cavity; and wherein attachment of said cap to said lower portion mates said upper cavity with said lower cavity to receive said bearing.

22. The dispenser as recited in claim 21, wherein said socket comprises polyacetal.

23. The dispenser as recited in claim 22, wherein said carrier member comprises stainless steel.

24. The dispenser as recited in claim 20, wherein said lower unit comprises:

a plurality of optical emitter assemblies vertically disposed upon a first interior face of said ice bin;

a plurality of optical receiver assemblies vertically disposed upon a second interior face of said ice bin, said second face being opposite said first face; and wherein said each said optical receiver assembly is adapted to receive an optical signal generated by one of said optical emitter assemblies for determining the level of ice within said ice bin.

25. The dispenser as recited in claim 24, wherein each said optical emitter assembly comprises:

an emitter housing, said emitter housing being fixedly attached to said first interior face and adapted for fixed electrical communication with a dispenser controller;

an emitter body, said emitter body comprising an optical source; and wherein said emitter body is adapted to removably mate with said emitter housing for establishing an electrical connection between said optical source and the dispenser controller.

26. The dispenser as recited in claim 25, wherein each said optical receiver assembly comprises:

a receiver housing, said receiver housing being fixedly attached to said second interior face and adapted for fixed electrical communication with the dispenser controller;

a receiver body, said receiver body comprising an optical receiver; and wherein said receiver body is adapted to removably mate with said receiver housing for establishing an electrical connection between said optical receiver and the dispenser controller.

27. The dispenser as recited in claim 26, wherein:

each said emitter assembly comprises a first key and a first slot, said first key being arranged relative to said first slot to facilitate mating of said emitter body with said emitter housing;

each said receiver assembly comprises a second key and second slot, said second key being arrange relative to said second slot to facilitate mating of said receiver body with said receiver housing; and said relative arrangement of said second key with said second slot differs from said relative arrangement of said first key with said first slot.

28. The dispenser as recited in claim 26, wherein said lower unit is adapted for connection of said ice bin with an automated ice delivery system.

29. The dispenser as recited in claim 20, said dispenser further comprising an conveyor speed selection switch, said conveyor speed selection switch being adapted to vary the rate at which said conveyor transfers ice from said ice bin to said interface.

30. The dispenser as recited in claim 19, wherein said lower unit comprises a cold plate, said cold plate being adapted to chill the drink product to be dispensed to the public.

31. The dispenser as recited in claim 30, wherein said carrier member is cast within said cold plate.

32. The dispenser as recited in claim 19, wherein said upper unit is adapted to provide a second interface for dispensing a drink product to the public.

33. The dispenser as recited in claim 32, wherein said second interface comprises:

a plurality of modular dispensing valves; and a plurality of mounting blocks, said mounting blocks being adapted to receive one each of said modular dispensing valves.

34. The dispenser as recited in claim 33, wherein:

said modular dispensing valves each comprise a first electrical connector and a first fluid connector;

said mounting blocks each comprise a second electrical connector and a second fluid connector; and wherein said first electrical connector is adapted to mate with said second electrical connector and said first fluid connector is adapted to mate with said second fluid connector.

35. The dispenser as recited in claim 34, wherein each said connector is positioned such that mating of said fluid connectors results in substantially simultaneous mating of said electrical connectors.

36. The dispenser as recited in claim 19, wherein said conveyor comprises an auger.

37. The dispenser as recited in claim 19, wherein said ice distributor comprises a wheel.

* * * * *